US006286801B1

(12) United States Patent
Collins et al.

(10) Patent No.: US 6,286,801 B1
(45) Date of Patent: Sep. 11, 2001

(54) APPARATUS FOR HOLDING BOOKS

(76) Inventors: Gary J. Collins, 1779 Jeffrey Ct., Santa Clara, CA (US) 95051; John Phillip Hindt, 10133 Melody Rd., Smartville, CA (US) 95977

( * ) Notice: Subject to any disclaimer, the term of this patent is extended or adjusted under 35 U.S.C. 154(b) by 0 days.

(21) Appl. No.: 09/353,347

(22) Filed: Jul. 15, 1999

(51) Int. Cl.[7] ..... A47B 97/04; A47F 5/00; A47F 7/00; F16M 11/00; F16M 13/00

(52) U.S. Cl. ..... 248/453; 248/125.9

(58) Field of Search ..... 248/125.9, 453, 248/125.8, 188.5, 917, 442.2

(56) References Cited

U.S. PATENT DOCUMENTS 5,058,848 * 10/1991 Ferraro ..... 248/441.1
5,149,047 * 9/1992 Tucker ..... 248/459
5,177,616 * 1/1993 Riday ..... 248/917
5,179,447 * 1/1993 Lain ..... 248/917
6,007,036 * 12/1999 Rosen ..... 248/286.1
6,036,152 * 3/2000 Hiscox et al. ..... 248/311.2

* cited by examiner

*Primary Examiner*—Leslie A. Braun
*Assistant Examiner*—J. DeLuca
(74) *Attorney, Agent, or Firm*—Thomas R. Lampe

(57) ABSTRACT

Adjustable, collapsible book holder apparatus includes an elongated double-ended support member and a connector at one of the ends of the support member. A double-ended elongated book support element is connected to the support member and can be moved both laterally and longitudinally relative to the support member to adjust the position of a book supported by the book support element.

14 Claims, 10 Drawing Sheets

APPARATUS FOR HOLDING BOOKS

TECHNICAL FIELD

This invention relates to an apparatus for holding books. The apparatus is particularly useful for holding books for reading by a person on a bed.

BACKGROUND OF THE INVENTION

The following United States patents are directed to book holders of various types: U.S. Pat. No. 3,514,066, issued May 26, 1970, U.S. Pat. No. 3,905,573, issued Sep. 16, 1975, U.S. Pat. No. 5,259,581, issued Nov. 9, 1993, U.S. Pat. No. 5,458,312, issued Oct. 17, 1975, U.S. Pat. No. 5,112,021, issued May 12, 1992, U.S. Pat. No. 4,465,255, issued Oct. 14, 1984, and U.S. Pat. No. 4,191,354, issued Mar. 4, 1980.

As can be seen with reference to the above-identified patents, it is generally known to employ a book holder for facilitating reading of a book by an individual on a bed. However, the above-identified patents do not disclose or suggest the combination of structural elements employed in the apparatus disclosed and claimed herein.

DISCLOSURE OF INVENTION

The present invention relates to an adjustable, collapsible book holder apparatus which is characterized by its relative simplicity, ease and flexibility of use, and relatively low cost, as compared to prior art devices. The present apparatus may be readily collapsed to provide a unitary compact package to facilitate storage of the apparatus when not in use. Also, the apparatus may readily and quickly be reconfigured from the compact storage configuration to its use configuration. The apparatus can be readily installed on a bed frame or other object and easily adjusted to satisfy the requirements of the user.

The adjustable, collapsible book holder apparatus of the present invention includes a double-ended elongated support member.

Connector means is disposed at one of the ends of the support member for connecting the support member to a bed frame or other object.

A double-ended book support element is included in the apparatus for selective attachment to the support member in either a first orientation relative to the support member wherein the book support element is attached at one of the ends thereof to the support member and extends laterally therefrom at a location spaced from the connector means or a second orientation relative to the support member wherein the book support element is disposed substantially parallel to and is in engagement with the support member.

Book holder means is connected to the book support element for holding a book in position on the book support element when the book support element is in its first orientation.

Other features, advantages, and objects of the present invention will become apparent with reference to the following description and accompanying drawings.

MODES FOR CARRYING OUT THE INVENTION

Referring now to FIGS. 1–12, a book holder apparatus constructed in accordance with the teachings of the present invention is illustrated and includes a double-ended elongated support member 10, a connector 12 disposed at one of the ends of the support member for connecting the support member to a bed frame or other object (not shown) and a double-ended elongated book support element 14. Support member 10, connector 12 and book support element 14 can be formed of any suitable material, such as plastic or metal.

Figure 1:
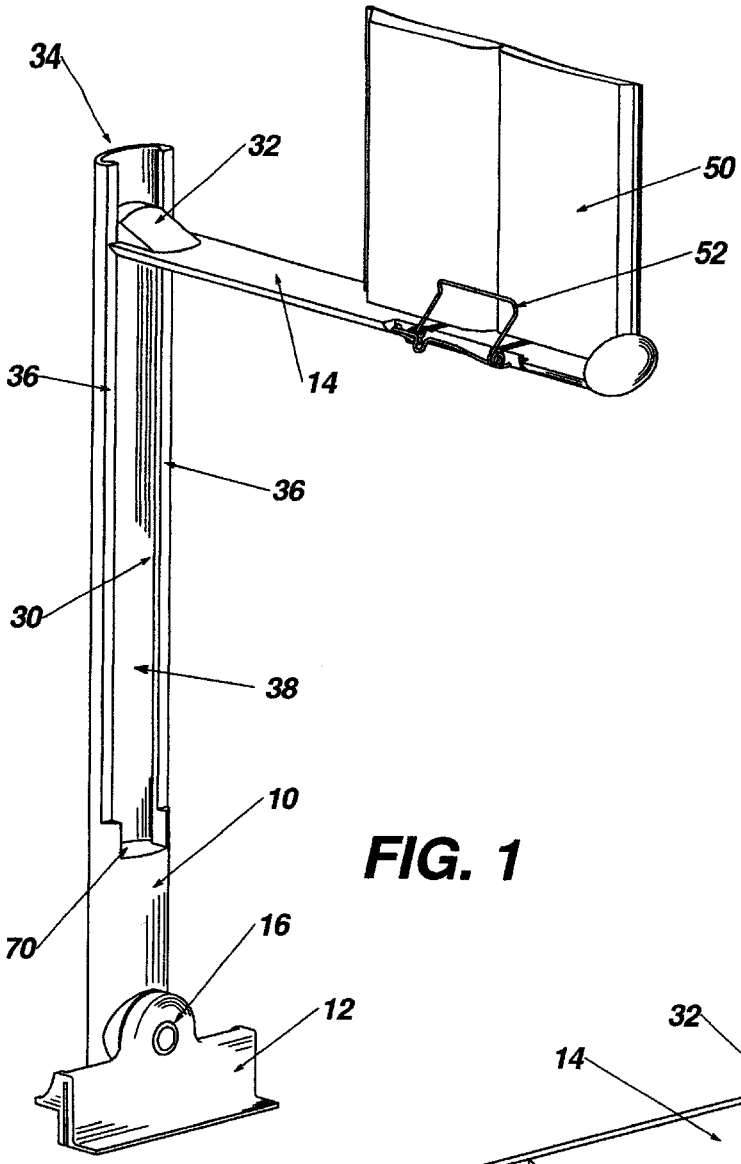
FIG. 1 is a perspective view of apparatus constructed in accordance with the teachings of the present invention in its book holding configuration.
Figure 2:
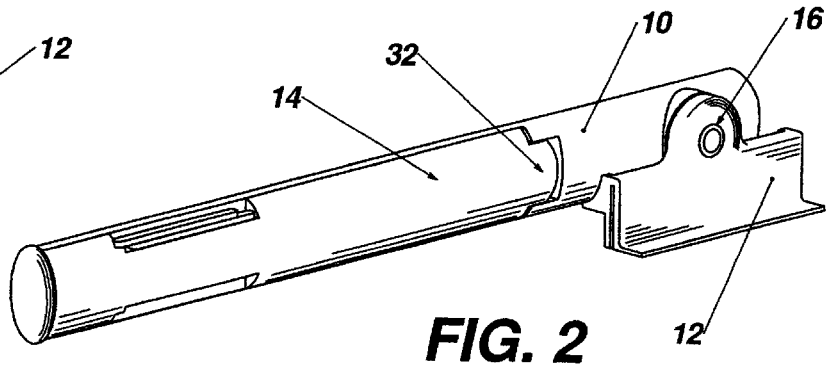
FIG. 2 is a perspective view of the apparatus in its compact, storage configuration wherein certain structural components are telescoped.
Figure 4:
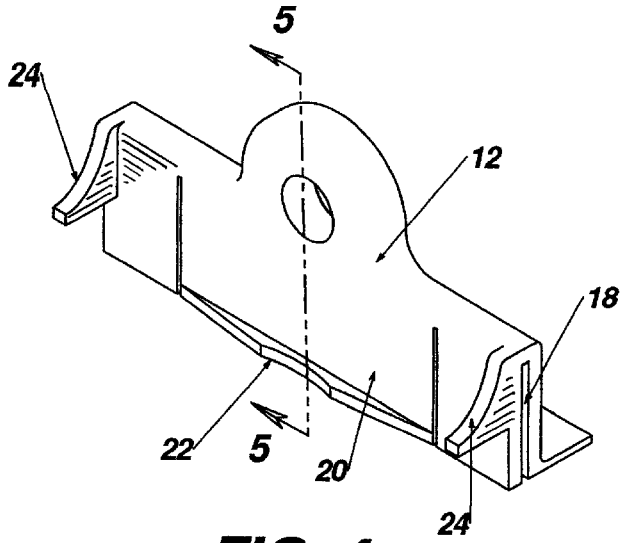
FIG. 4 is an enlarged, perspective view of a connector employed to attach the apparatus to a bed frame or other object.
Figure 5:
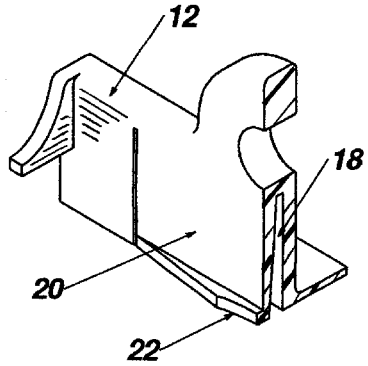
FIG. 5 is a cross-sectional view taken along the line 5—5 in FIG. 4.
Figure 3:
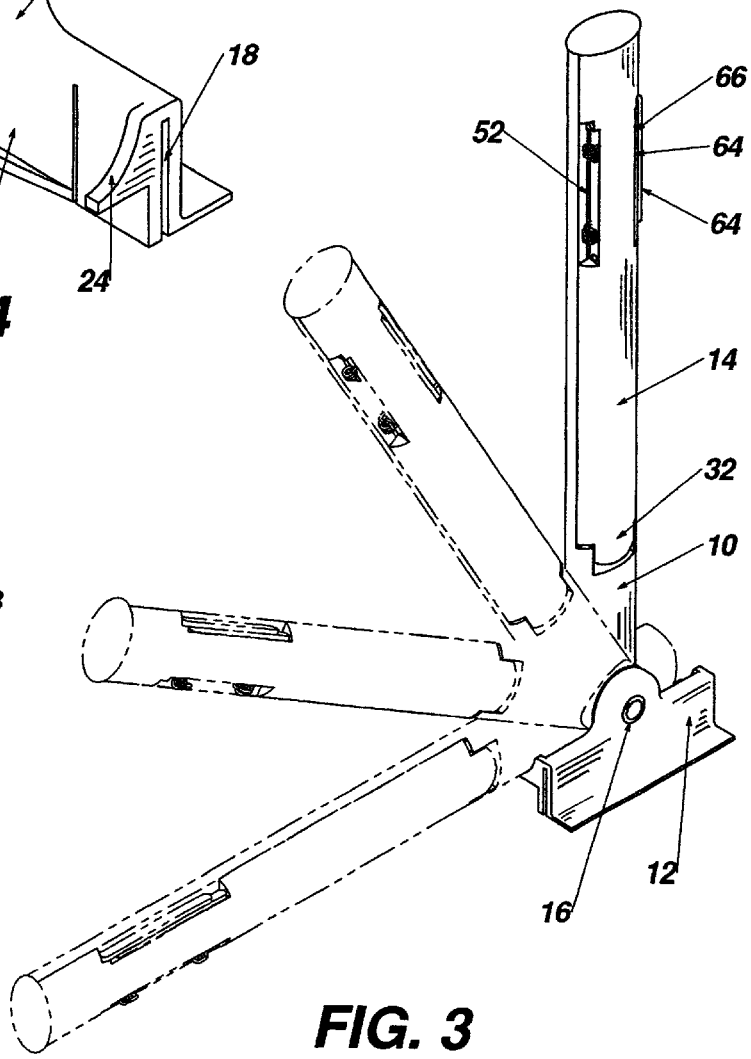
FIG. 3 is a perspective view of the apparatus with certain structural elements thereof being disposed at alternate positions.
Figure 6:
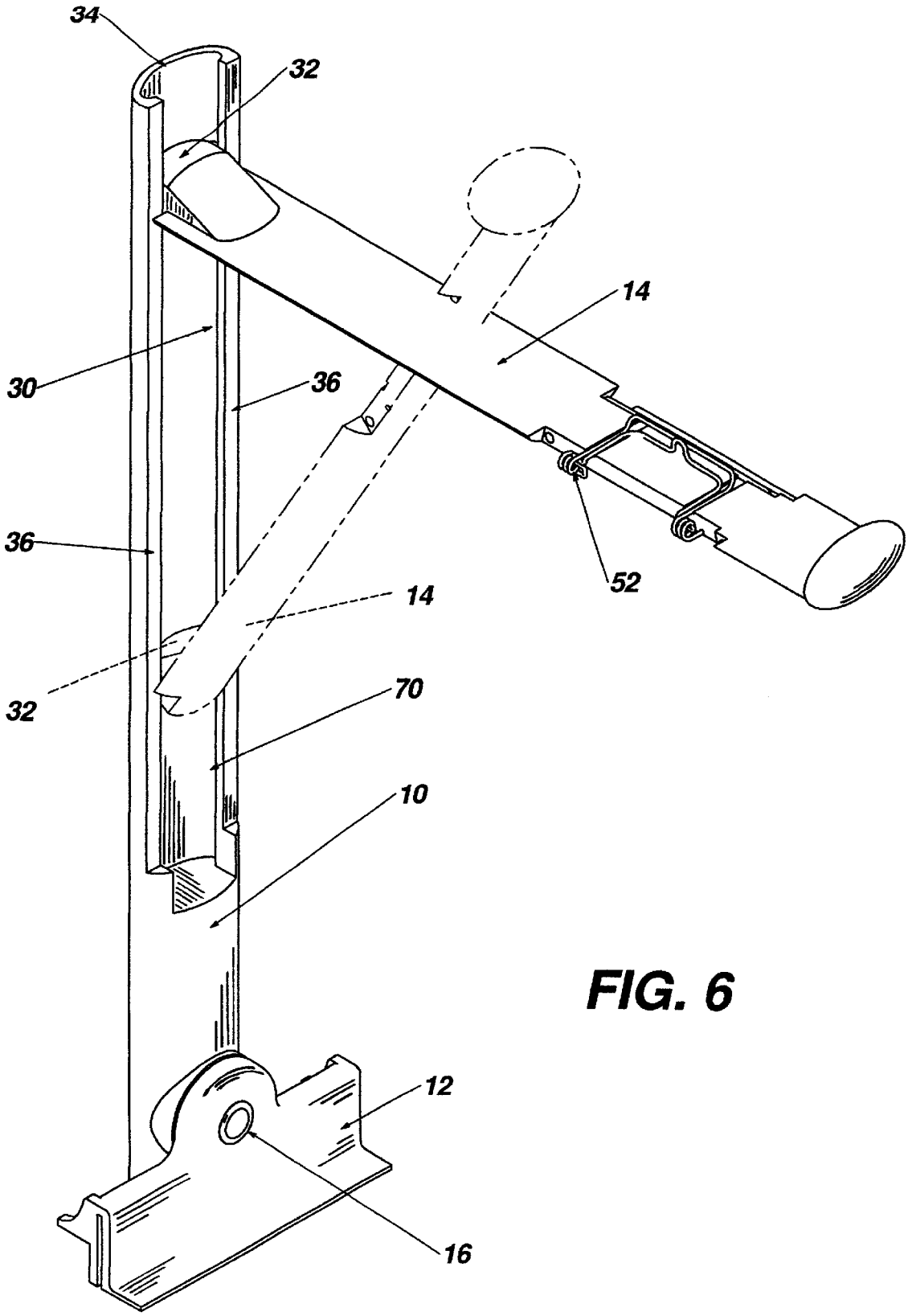
FIG. 6 is a perspective view of the apparatus with the book support element thereof extending laterally from the support member thereof, the book support element being shown in two alternate positions, one illustrated by solid lines and the other by dash lines.
Figure 7B:
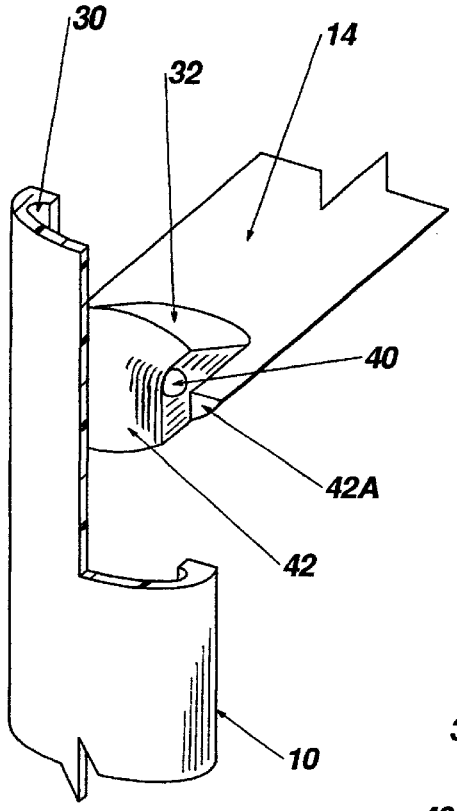
FIGS. 7A and 7B are enlarged perspective views in partial cross-section illustrating details of selected portions of the support member and book support element from the front and back, respectively.
Figure 7A:
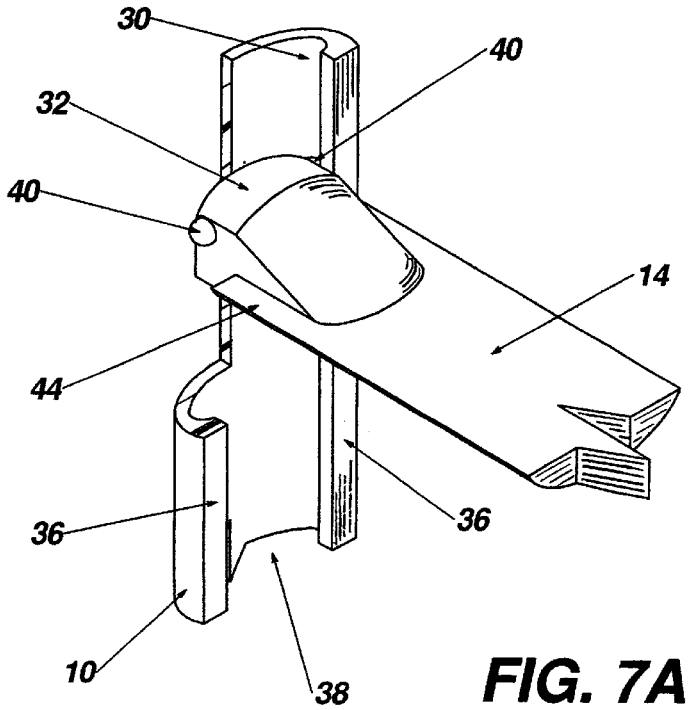

Support member 10 is pivotally connected to connector 12 by any suitable expedient, for example a pivot pin 16, so that the connector and support member can be relatively pivoted between the two relative positions shown in FIGS. 1 and 2. This is also demonstrated in FIG. 3 wherein the support member 10 is shown projecting vertically upwardly from the connector, in a horizontal position, and also in two intermediate positions, the latter three positions being shown in dash lines.

Connector 12 includes a slot 18 which passes completely from one end of the connector to the other and is for the purpose of retaining a portion of a bed frame, for example, to mount the apparatus on the bed frame. The connector 12 includes stabilizer means for yieldably maintaining the support member substantially vertical. In particular, the stabilizer means is in the form of a flexible tab 20 which is positioned at one side of the connector (as perhaps may best be seen with reference to FIGS. 4 and 5). A tab 20 defines an indentation 22 for receiving the support member when the support member is vertical. However, upon application of sufficient manual force, the tab is deflected to enable the support member to be moved to its position shown in FIG. 1. The slot 18 is enlarged at the location of the tab to enable the tab to flex relative to the bed frame element or other object to which the connector is engaged. Projections 24 are employed to limit relative movement between the support member and the connector. When the apparatus is in its collapsed condition, one of the projections will be engaged by the support member as shown in FIG. 2.

Support member 10 defines a recess 30 for receiving an end 32 of book support element 14. The recess is elongated and extends along a substantial length of the support member 10. The support member also defines an end opening 34 communicating with the recess to allow for the manual removal of the end 32 from the recess or its insertion into the recess. A pair of elongated, spaced, parallel flanges 36 are on the support member, extending along the recess and defining an elongated opening 38 communicating with the recess.

End 32 of the book support element has a pair of projections 40 thereon, the projections being formed on opposed sides of the end, located in the recess 30 and bearing against and exerting outwardly directed locking forces on the inner surfaces of the flanges 36 when the book support element is in its orientation relative to the support member shown in FIG. 1, (for example), hereinafter known as the first orientation.

The book support element has a bearing surface 42 which is spaced from the projections 40 and bears against and exerts an inwardly directed locking force against the back of the support member when the book support element is in the first orientation. The outwardly directed locking forces of the projections and the inwardly directed locking force of the bearing surface 42 result from the force of gravity applied to the book support element when the book support element is in its first orientation. If desired, the ends 42A of flanges 44 also may constitute bearing surfaces bearing against and exerting inwardly directed locking forces against the outer surfaces of the flanges.

It will be appreciated that the position of the book support element 14 can be changed along the vertical axis of the support member 10, that is, end 32 may be selectively moved up or down and locked into position. To move the book support element up or down relative to the support member the user exerts an upwardly directed force on the book support element to tilt it. This is shown by the dash line depiction of book support element 14 in FIG. 6. This releases the locking forces otherwise exerted by the projections 40 and the bearing surface 42 so that the end 32 may be slid up or down. When the desired height is reached, the book support element 14 is again returned to its horizontal position to lock end 32 in place relative to the support member.

Connected to book support element 14 are book holder members which cooperate to maintain a book 50 in position on the book support element with the book open to the desired pages.

One such book holder member is designated by reference numeral 52. Book holder member 52, as shown, is formed of wire and includes a first member portion 54 and a second member portion 56. The ends of first member portion 54 are coiled and located in spaced holes formed in the book support element 14, the coils constituting springs 60 biasing the distal end of member 54 to the position shown in FIG. 10 where it will engage the exposed pages of the book.

Figure 10:
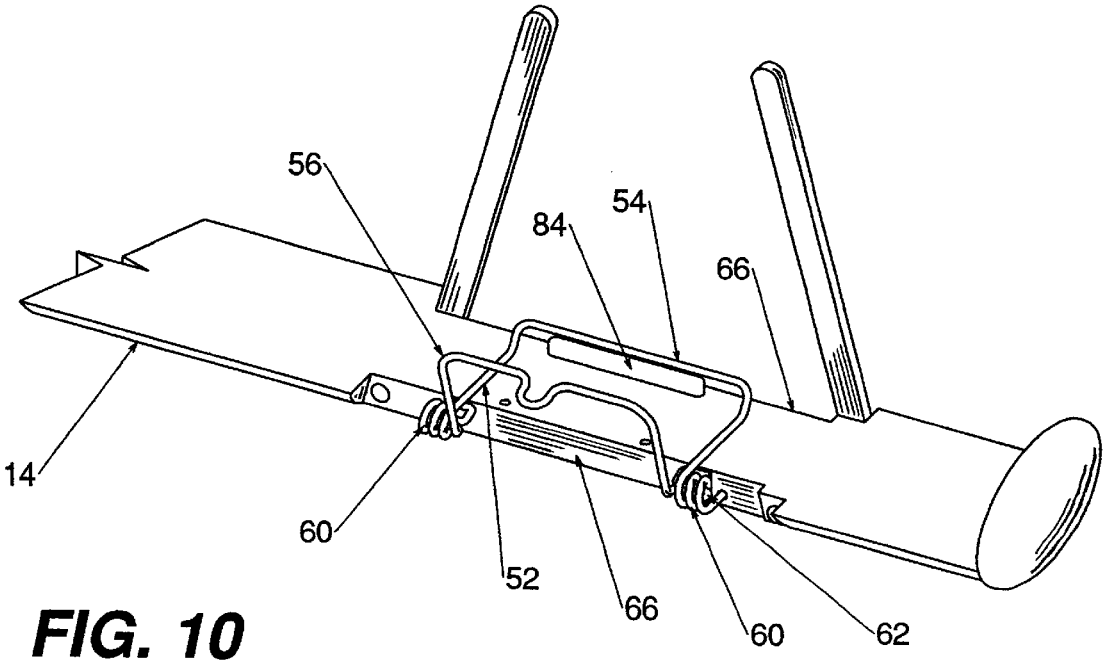
Figure 11:
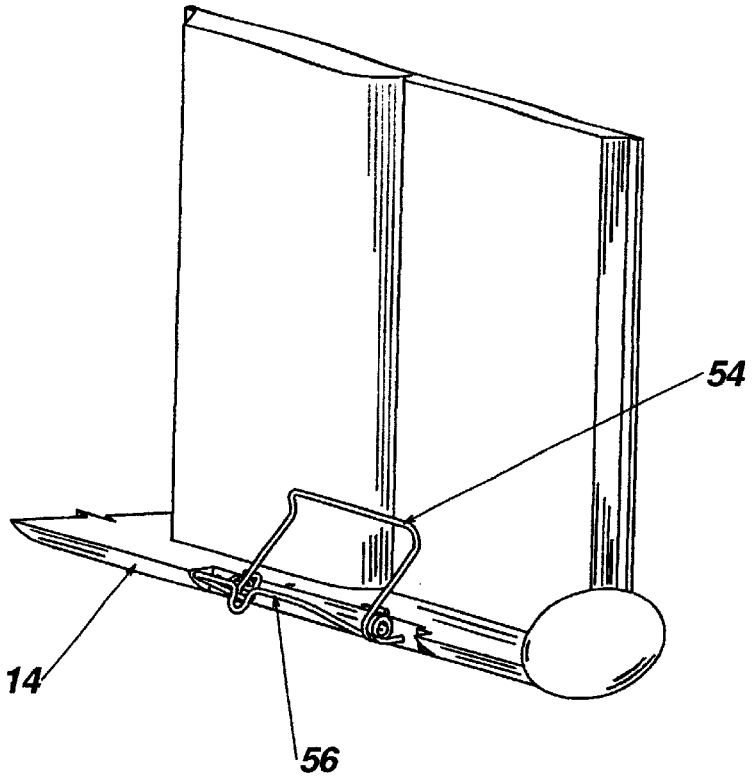
FIGS. 11 and 12 are perspective views illustrating a portion of the book support element of the invention supporting a book, a biased book holder member being illustrated in two alternate positions in the figures.
Figure 12:
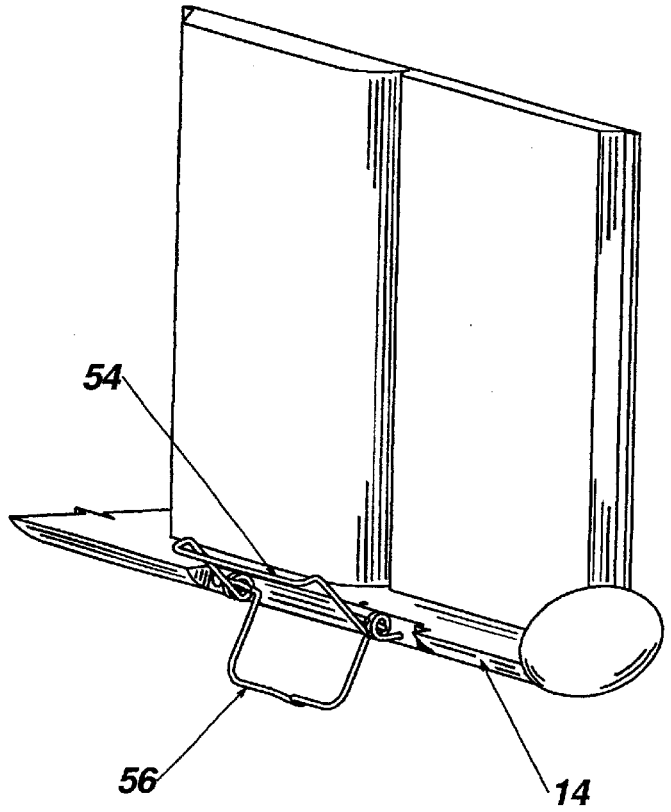

Second member portion 56 has bights 62 formed at the sides thereof which are located within the interiors of spring coils 60. Extremities of the bights 62 engage the underside of first member portion 54 as shown in FIG. 10 when the second member portion 56 is pivoted from the position shown in FIG. 9 to the position shown in FIG. 10. This will enable the reader to readily withdraw first member portion 54 from the book (see FIG. 12) by manipulating portion 56 so that the pages can be turned.

As soon as the pages are turned the reader allows first member portion 54 to return to engagement with the book pages.

Figure 8:
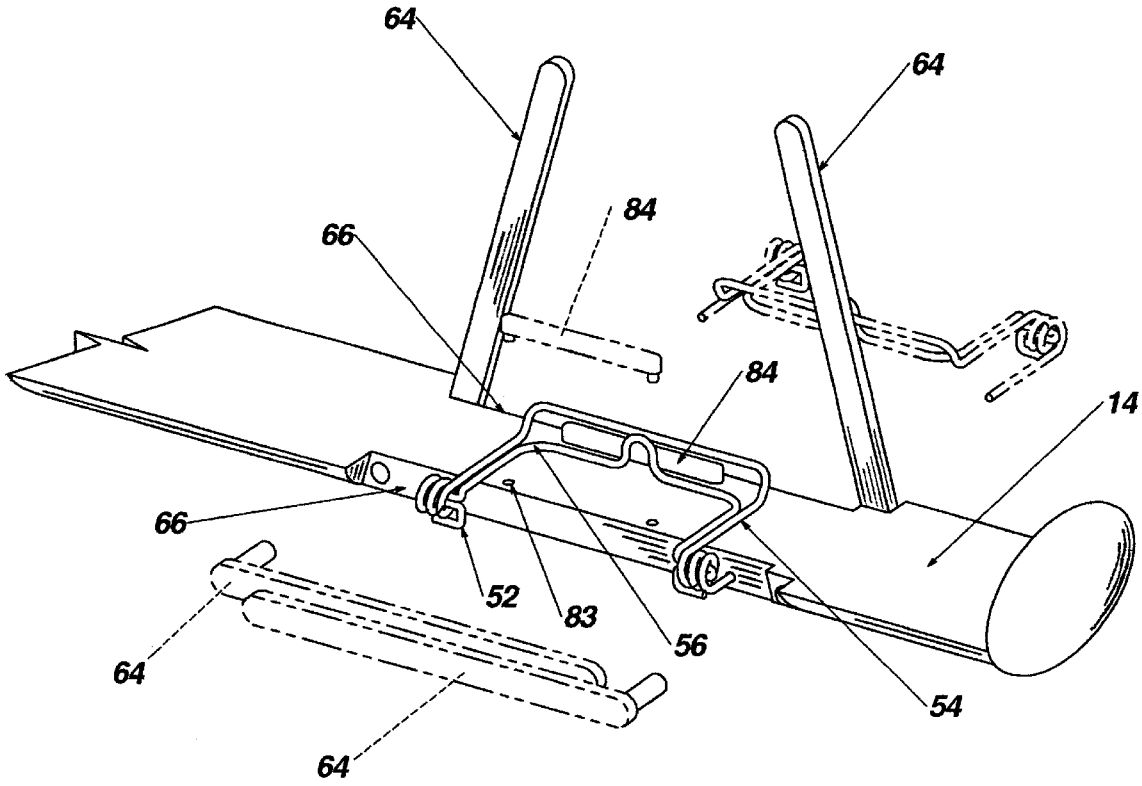
FIG. 8 is a perspective view illustrating a portion of the book support element and book holder members operatively associated therewith, the book holder members being shown in two relative alternative positions, one designated by solid lines and the other by dash lines.
Figure 9:
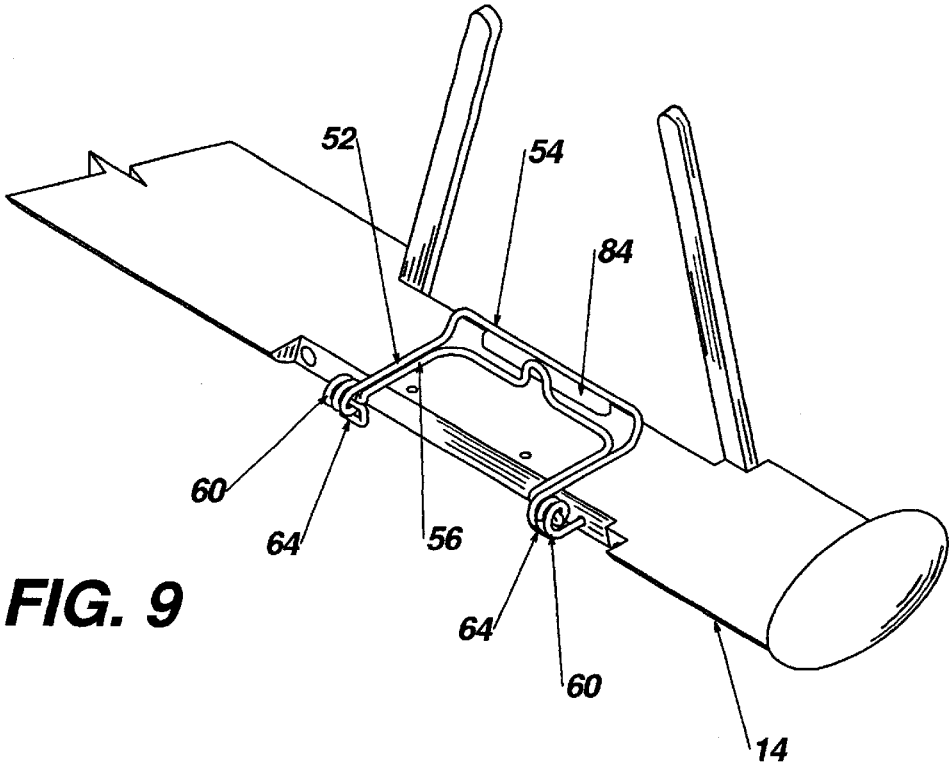
FIGS. 9 and 10 are perspective views of a portion of the book support element and the book holder members, one of the book holder members being in one condition or state in FIG. 9 and another in FIG. 10.

Second book holder member comprises two support arms 64 which are pivotally mounted on the book support element. The arms 64 can be pivoted from the position shown in FIGS. 8, 9 and 10 to a position wherein the arms 64 overlap within a notch 66 of the book support element. A notch 66 is located at each of the opposed sides of the book support element 14 and holes are formed on both sides of the book support element 14 to accommodate either book holder member 52 or the arms 64 comprising the other book holder member. This enables the positions of the book holder members to be reversed, a feature which is illustrated in FIG. 8 by the solid line and dash line representations of the book holder members. A projecting element 84 is employed to engage the lower back of a book to provide added stability. The position of the projecting element 84 can also be reversed as shown by the solid and dash line representations.

As previously stated, the apparatus may readily be moved from the configuration shown in FIG. 1 to the compact configuration shown in FIG. 2. In the compact configuration the book support element 14 is disposed parallel to and in engagement with the support member. The support member is reduced in size in the area of the recess 30 to define an elongated cavity 70 communicating with the recess. Elongated cavity 70 accommodates the book support element in nesting condition with respect to the support member when the book support element is in the second orientation shown in FIG. 2. The book support element 14 is moved to its nested position simply by tilting the book support element and sliding end 32 to the lowermost end of recess 30.

Figure 13:
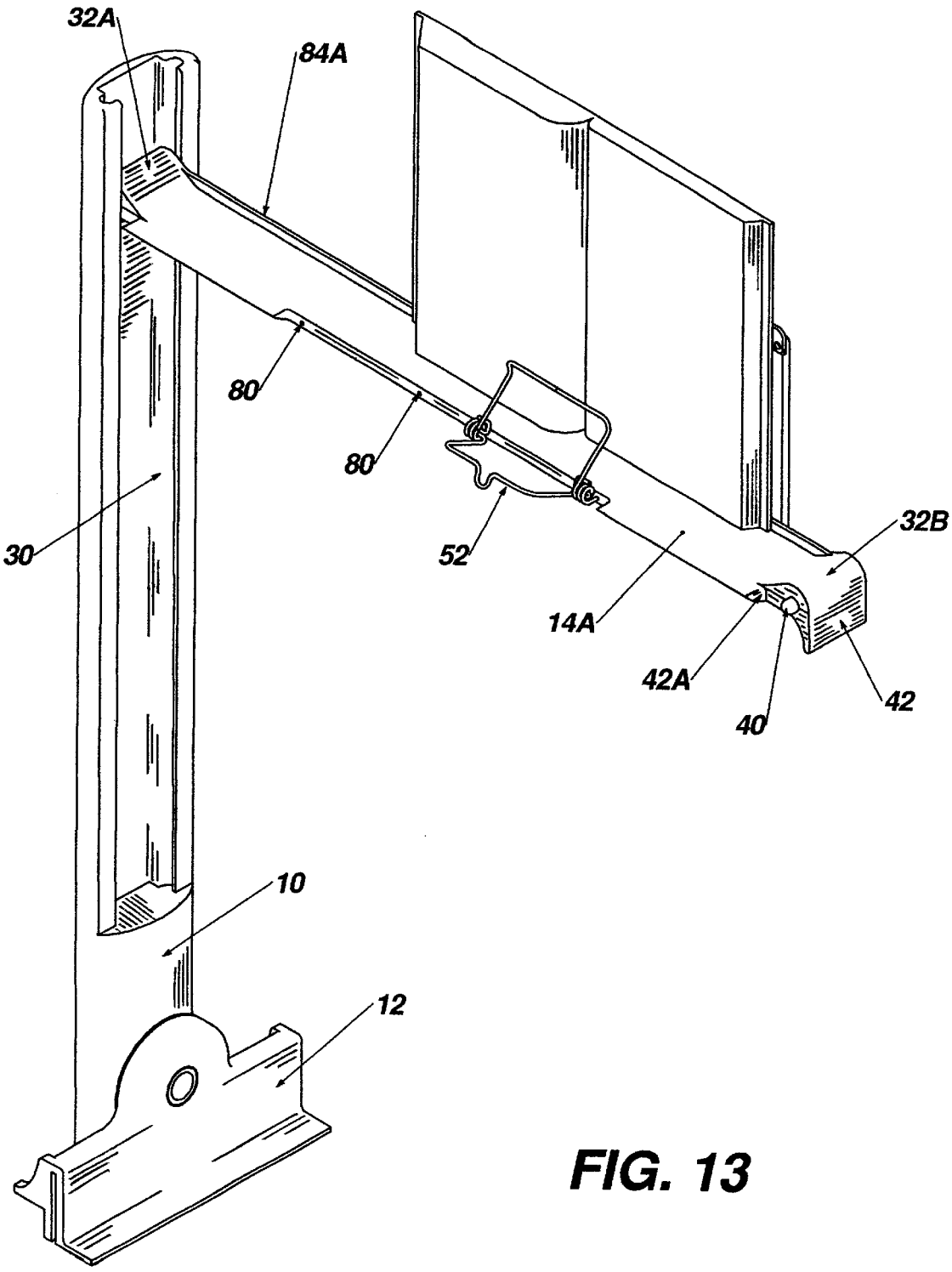
FIG. 13 is a frontal, perspective view of another embodiment of the invention, with the apparatus assuming the configuration existing when holding a book.
Figure 14:
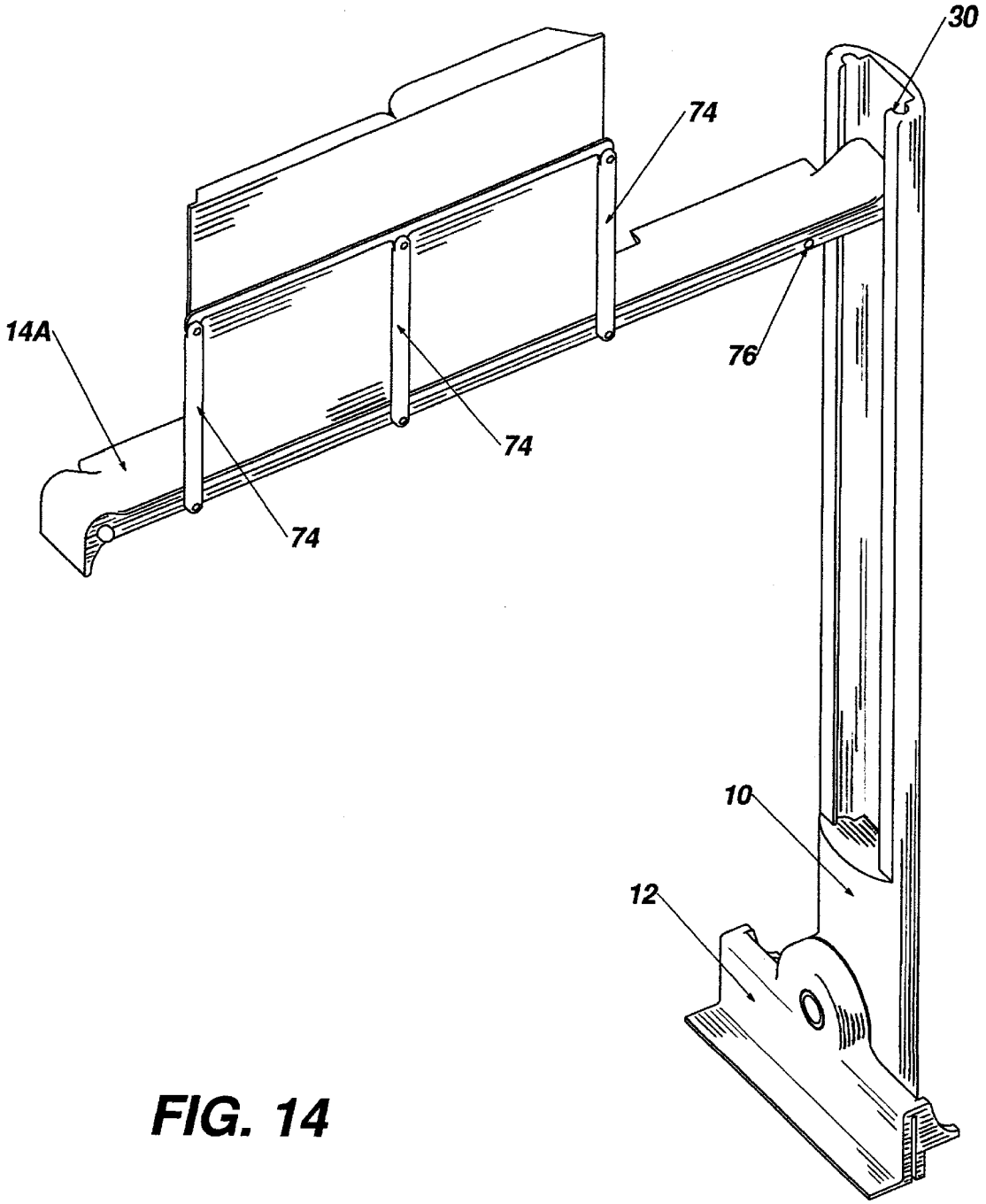
FIG. 14 is a rear perspective view of the apparatus embodiment of FIG. 13.
Figure 15:
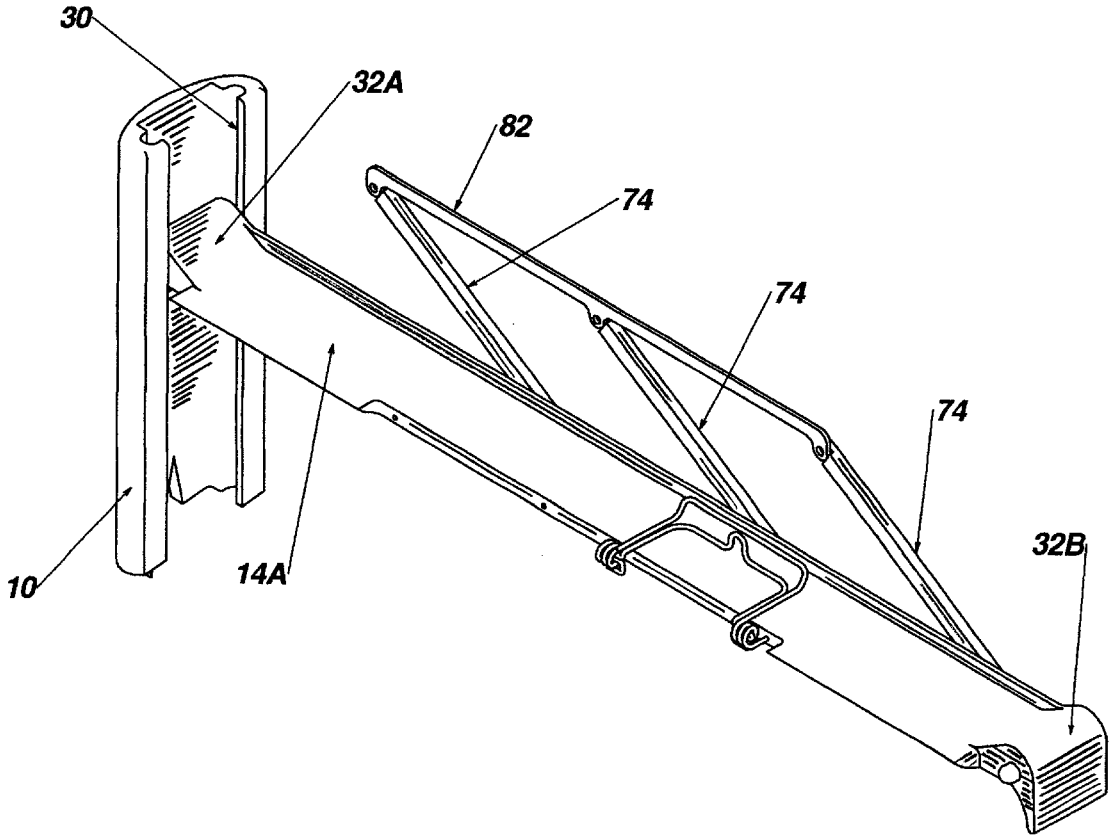
FIG. 15 is a frontal perspective view of selected portions of the embodiment of FIG. 13 and showing a book holder member between its collapsed and use conditions or states.

FIGS. 13–15 illustrate an alternative embodiment of the apparatus which differs from the first embodiment described in detail above in several respects. First of all, the ends 32A and 32B of the book support element 14 are of identical construction so that either end of the book support element 14A can be connected to support member 10. In addition, the second book holder member comprises three arms 74 pivotally connected at their lower ends to the book support element 14 at holes 76 (only one of which is shown) formed along one side of the book support element. The other side of the book support element has spaced holes 80 formed therein for receiving the attachment elements of book holder member 52. The upper ends of arms 74 are pivotally connected to a bar 82. The arms 74 may be pivoted as shown in FIG. 15 until they and the bar are disposed alongside the book support element 14. The plurality of holes formed along the sides of the book support element 14 enable the book holder members to be selectively positioned at various locations along the length of the book support element. An elongated projecting element 84A is employed to engage the lower back of a book as shown.

What is claimed is:

1. Adjustable, collapsible book holder apparatus, said apparatus comprising, in combination:

a double-ended elongated support member;

connector means disposed at one of the ends of the support member for connecting the support member to a bed frame or other object and for maintaining the support member in a generally vertical orientation extending upwardly from said connector means;

an elongated book support element having first and second ends for selective attachment to said support member in either a first orientation relative to said support member wherein said book support element is attached at the first end thereof to the support member and extends laterally therefrom at a location spaced from said connector means or a second orientation relative to said support member wherein said book support element is disposed substantially parallel to said support member, said book support element when in said first orientation extending in a generally horizontal direction when said support member is in a generally vertical orientation;

locking means for selectively alternatively locking the first end of said book support element in position at a plurality of locations along said support member, said locking means including at least one projection projecting from the first end of said book support element engageable with said support member and a bearing surface formed on the first book support element spaced from the at least one projection and engageable with said support member, at least a portion of said support member being disposed between said at least one projection and said bearing surface when said book support element is in said first orientation with said at least one projection applying an outwardly directed locking force to said support member and said bearing surface applying an inwardly directed locking force to said support member, said inwardly and outwardly directed locking forces resulting from the force of gravity applied to said book support element when said book support element is in said first orientation, the first end of said book support element being selectively slidable along said support member when said book support element is not in said first orientation to change the distance between said connector means and said book support element, and said book support element being manually tiltable about the first end thereof relative to said support member upon application of an upwardly directed manual force thereto to move said book support element out of said first orientation; and book holder means connected to said book support element for holding a book in position on said book support element when said book support element is in said first orientation.

2. The apparatus according to claim 1 wherein said support member defines an elongated recess extending along a substantial length of said support member for receiving at least a portion of said book support element when said book support element is in either said first orientation or in said second orientation.

3. The apparatus according to claim 2 wherein said locking means additionally includes two elongated, spaced, parallel flanges on said support member extending along said recess and defining an elongated opening communicating with said recess and wherein a plurality of projections project from the first end of said book support element and are located on opposed sides of the first end of said book support element, said first end and said projections located in the recess and bearing against and exerting outwardly directed locking forces on inner surfaces of said flanges when said book support element is in said first orientation.

4. The apparatus according to claim 3 wherein said support member defines an end opening communicating with said recess to allow the manual removal of the first end of said book support element and said projections from said recess.

5. The apparatus according to claim 2 wherein said support member is reduced in size in the area of said recess to define an elongated cavity communicating with said recess, said elongated cavity accommodating said book support element when said book support element is in said second orientation.

6. The apparatus according to claim 1 wherein said support member is pivotally connected to said connector means and selectively movable relative thereto between said generally vertical orientation and a generally horizontal orientation, said connector means including stabilizer means for yieldably maintaining said support member in said generally vertical orientation.

7. The apparatus according to claim 6 wherein said stabilizer means includes a flexible tab formed in said connector means in engagement with said support member when said support member is in said generally vertical orientation.

8. The apparatus according to claim 1 wherein said book holder means comprises first and second book holder members located on opposed sides of said book support element and cooperable to maintain a book in place and supported by the book element, said first and second book holder members both being selectively removable from said book support element whereby the positions of said first and second book holder members can be reversed on said book support element.

9. The apparatus according to claim 8 wherein said book support element defines notches on opposed sides thereof for receiving said first and second book holder members.

10. The apparatus according to claim 8 wherein said book holder element defines a plurality of spaced holes on opposed sides thereof, said holes for receiving portions of said first and second book holder members to releasably retain said first and second book holder members on said book holder element.

11. The apparatus according to claim 8 wherein said first and second book holder members and said book support element include cooperable mounting structure enabling said first and second book holder members to be positioned at different locations along the length of said book support element.

12. The apparatus according to claim 8 wherein one of said holder members comprises at least one support arm pivotally mounted on said book support element.

13. The apparatus according to claim 1 wherein the ends of said book support member are substantially identical whereby either end may be attached to said support member.

14. The apparatus according to claim 1 wherein said support member and said book support element are telescoped to a compact size when said book support element is in said second orientation.

* * * * *